United States Patent [19]

Plumadore

[11] 4,244,321

[45] Jan. 13, 1981

[54] ELECTROGRAPHIC DEVELOPMENT ELECTRODE

[75] Inventor: John D. Plumadore, Westfield, Mass.

[73] Assignee: James River Graphics, Inc., South Hadley, Mass.

[21] Appl. No.: 877,772

[22] Filed: Feb. 14, 1978

[51] Int. Cl.[3] ..... G03G 13/10; G03G 15/10

[52] U.S. Cl. ..... 118/648; 118/647; 118/660; 430/103; 355/10

[58] Field of Search ..... 355/3 DD, 10; 118/648, 118/647, 649, 660; 430/103

[56] References Cited

U.S. PATENT DOCUMENTS

| | | | |
|---|---|---|---|
| 3,892,481 | 7/1975 | Schaefer | 355/10 |
| 3,964,436 | 6/1976 | Plumadore | 118/647 |
| 4,006,709 | 2/1977 | Miyakawa et al. | 118/648 |
| 4,052,127 | 10/1977 | Kuroishi et al. | 118/648 |

OTHER PUBLICATIONS

Schaffert *Electrophotography* Focal Press, 1966, p. 28.

*Primary Examiner*—Dennis E. Talbert, Jr.
*Assistant Examiner*—John L. Goodrow
*Attorney, Agent, or Firm*—Burns, Doane, et al

[57] ABSTRACT

A development electrode arrangement located in closely-spaced parallel relation to the charge retaining surface of a moving electrographic recording medium. A toner application unit feeds electrostatically charged toner particles into the space between the development electrode arrangement and the charge retaining surface of the recording medium. The development electrode arrangement is comprised of an array of electrode segments each segment being electrically isolated from each other segment and each segment being allowed to float electrically. The floating electrode segments are so arranged that every element of the recording medium that is subjected to the toning process passes over at least one electrode segment during the toning process.

5 Claims, 4 Drawing Figures

ELECTROGRAPHIC DEVELOPMENT ELECTRODE

The Government has rights in this invention pursuant to Contract Number F33615-76C-1312, awarded by the U.S. Air Force AFSC Aeronautical Systems Division.

BACKGROUND OF THE INVENTION

This invention relates generally to the development of latent electrostatic images on a moving electrographic recording medium, and in particular to an improved development electrode array for assisting the deposition of electrostatically charged toner particles on the charge retaining surface of the moving recording medium.

In one type of electrophotographic recording process, the recording medium is a film having a polyester base, a transparent conductive layer that overlies the polyester base and a photoconductive layer that overlies the transparent conductive layer. To record on the film, a uniform electrostatic charge is first applied, by means of a charging corona element, to the surface of the photoconductive layer of the film. The uniform charge is then selectively dissipated by exposing the surface to a light image of the pattern to be recorded. The resulting pattern of charges is an electrostatic latent image on the surface of the photoconductive layer which can then be rendered visible, for example, in an attraction toning process, by applying liquid toner containing electrostatically charged developer particles in suspension to the surface of the photoconductive layer. The charged developer particles are attracted and held to the surface of the photoconductive layer by the electrostatic force developed between the developer particles and the charge retained on the surface of the photoconductive layer. A permanent visible image can be obtained, for example, by using developer particles which can be heat fused to the photoconductive layer, and then subjecting the visible image to a heat fusing step.

It is well known in the electrophotographic art that the development process is improved when a development electrode is used to assist the deposition of electrostatically charged particles on the charge retaining surface of the recording medium. As disclosed at page 28 of Electrophotography by R. M. Schaffert, published by the Focal Press, 1966, it is common to apply a suitable positive or negative voltage to the development electrode to compensate for incorrect exposure, to alter the tonal characteristics of a picture or to accomplish reversal development.

As disclosed in U.S. Pat. No. 3,964,436, issued to John D. Plumadore, and assigned to the assignee of this invention, electrophotographic recording systems can have variations in the imaging-light intensity, variations in the degree of darkness of documents being copied, and variations in the properties of the photoconductors used in the recording medium. These variations can result in the electrostatic charge potentials which remain on the film after imaging being higher or lower than desired, which in turn affects the attractive forces upon the toner particles during development. Of particular importance is the difference between the highest and lowest charge potential on the imaged film. Where this difference is very slight, there is a tendency to produce dark, or unclean, background areas in the image. Additionally, where the lowest charge potential on the imaged film is greater in magnitude than zero, there is a tendency for the toner particles to also deposit in the areas having that lowest charge potential. In the preferred type of electrophotographic recording apparatus, the background of the documents being copied usually corresponds to the lowest charge potential on the film, and that area on the film is seldom discharged to zero, due to photoconductor properties and/or practical limitations on imaging-light duration and intensity.

As disclosed in the Plumadore U.S. Pat. No. 3,964,436, the variations in the electrostatic charge potentials on the imaged film can be handled by a large area development electrode that is electrically floating and positioned parallel to and close to the area of the film being developed during application of toner particles to the frame. The large area development electrode has induced upon it an electrostatic potential between the highest and lowest charge potential on the area of the film being developed.

Besides the variations discussed in the aforementioned Plumadore patent, in a given image area there can be a variation in the charge potential on the recording medium that corresponds to the background area of the image being recorded. For example, the optical system used to expose the charged conductive layer of the medium will usually illuminate the central portion of the image more effectively than the peripheral portions of the image. Thus, for a given image background, a lower charge potential will occur at the central portion of the image area than at the peripheral portions of the image area. In order to prevent toning of the background areas, the potential of the development electrode must exceed the charge potential on the recording medium that corresponds to the background area. When a large area floating development electrode as described in the previously discussed Plumadore patent is employed wherein the floating development electrode subtends the entire image area being developed, the floating development electrode will have induced on it a potential approximately equal to the average potential of the entire imaged area. For images that contain a very high percentage of background area, the potential induced on the development electrode can approach or even become less than the charge potential level that corresponds to the background areas in the peripheral portion of the image. If that occurs, some toner particles, in an attraction toning process, will be deposited on the peripheral background areas.

One electrophotographic recording system that employs plural floating electrodes is disclosed in U.S. Pat. No. 3,892,481, issued to L. F. Schafer et al. However, the floating electrodes 62, 64, 66 of that system are not employed as development electrodes. The system described in Schafer et al does employ a plurality of development electrodes 72, 74, 76, 78, each development electrode being connected to a voltage source. The floating electrodes are used to sense the charge potential of three areas across the width of the recording medium. A circuit selects the floating electrode having the lowest induced voltage to control the voltage level applied to the development electrodes.

It is an object of this invention to provide an improved development electrode arrangement for assisting the deposition of charged toner particles to the charge retaining surface of a moving electrographic recording medium.

It is another object of this invention to provide an improved floating electrode arrangement for assisting the development of a latent electrostatic image on a moving electrographic recording medium.

And yet another object of this invention is to provide a developing electrode arrangement that is able to adjust to varying background charge potential levels that may exist in different portions of the image area being developed.

SUMMARY OF THE INVENTION

In accordance with this invention, a development electrode arrangement is located in closely-spaced parallel relation to the charge retaining surface of a moving electrographic recording medium. A toner application unit feeds electrostatically charged toner particles into the space between the development electrode arrangement and the charge retaining surface of the recording medium. The development electrode arrangement is comprised of an array of electrode segments each segment being electrically isolated from each other segment and each segment being allowed to float electrically. The floating electrode segments are so arranged that every element of the recording medium that is subjected to the toning process passes over at least one electrode segment as it passes by the development electrode arrangement. In one preferred embodiment of the invention, the development electrode arrangement comprises plural rows of rectangular electrode segments oriented so that the short dimension of the rectangular segments is parallel to the direction of travel of the recording medium. The rectangular electrode segments are staggered in alternate rows so that the array presents a brickwork pattern.

DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

DETAILED DESCRIPTION

Figure 1:
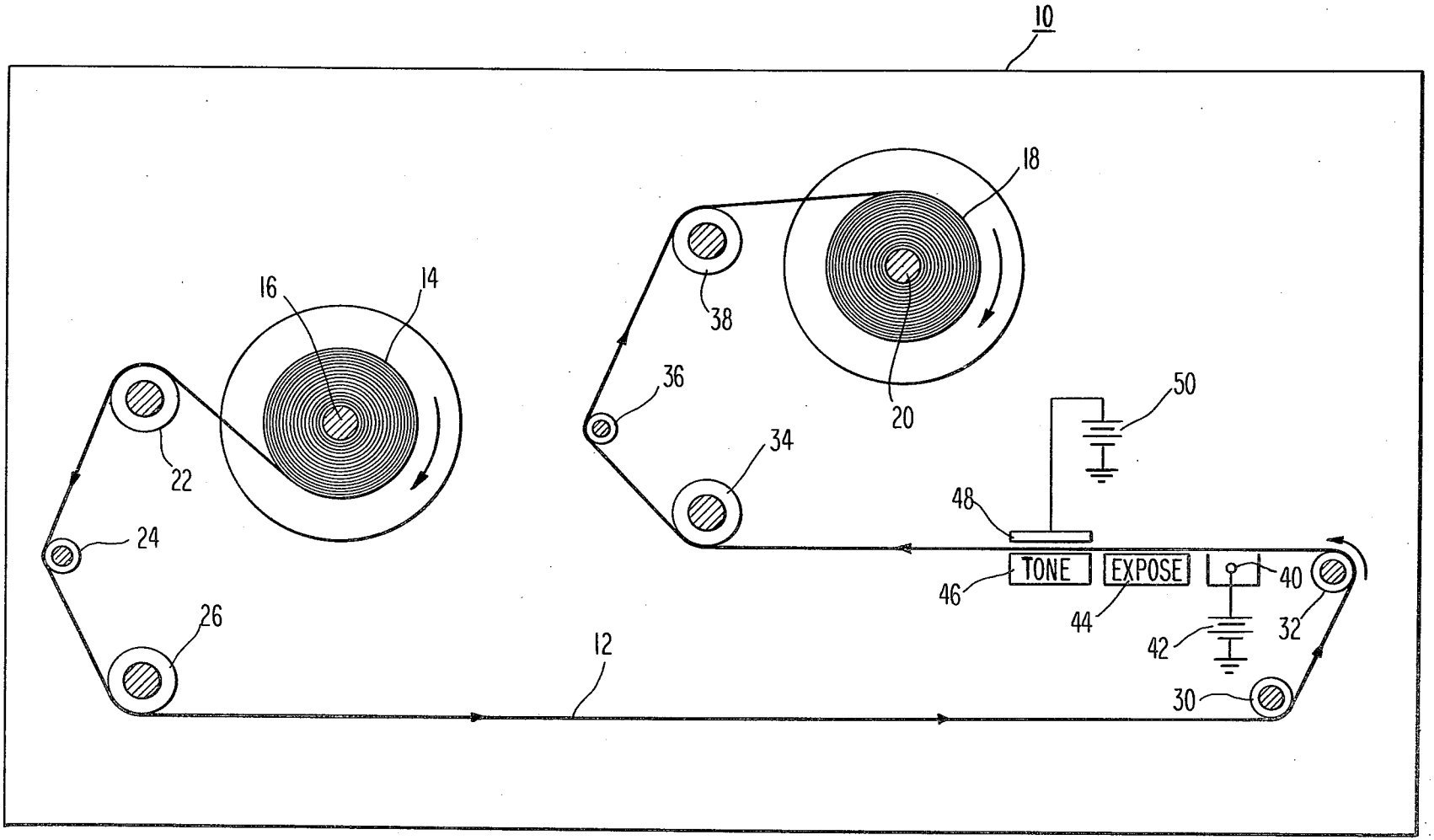
FIG. 1 is a block diagram of an electrophotographic film recorder having a development electrode arrangement in accordance with the invention.

FIG. 1 is a block diagram of an electrophotographic film recorder 10 that incorporates the development electrode arrangement of this invention. For the sake of convenience, an element depicted in more than one figure will retain the same element number in each figure. The recording medium 12 is transported from a supply roll 14, around guide rollers 22, 24, 26, 30, then around drive roller 32, and then further around guide rollers 34, 36, 38 and onto a take-up roll 18. The supply roll 14 and the take-up roll 18 can either be wound on reels (not shown) or wound directly onto a supply shaft 16 and a takeup shaft 20, respectively. To effect the transport of the film through the recorder it is generally common to provide motor drive and brake means (not shown) to the take-up shaft 20.

Although the development electrode arrangement of this invention can be used to assist the deposition of charged toner particles to different types of recording media, one embodiment of this invention has been used to develop an electrophotographic film designated as statigraph film manufactured by Scott Graphics, Inc. located in South Hadley, Mass. The electrophotographic film has three layers. The first layer is a polyester base, about 125 micrometers thick, that forms an insulative substrate for the film. Overlying the polyester base is a second, transparent conductive layer about 0.01 micrometers thick. The film structure is completed by a photoconductive film matrix, about 9 micrometers thick that overlies the transparent conductive layer.

In accordance with conventional techniques for recording on the electrophotographic film 12, a corona charging unit 40 deposits a uniform distribution of charge on the surface of the photoconductive layer of electrophotographic film 12. A conventional high voltage power supply 42 energizes the corona charging unit 40. The uniformly charged photoconductive layer of the film 12 is then transported past an exposure station 44. At the exposure station 44, in accordance with well-known techniques, the charged surface of the film 12 is subjected to a light pattern that corresponds to the desired image to be recorded on the film 12. Those areas of the charged photoconductive layer of the film 12 that are exposed to the light become conductive and the charge originally deposited on those exposed areas of the photoconductive layer of the film 12 will be dissipated. Those areas of the charged photoconductive layer of the film 12 that are not exposed to light will retain a charge thereon. At this stage of the recording process, the distribution of charge representing the desired image to be recorded is referred to as an electrostatic latent image since it is not visible to the naked eye. In order to provide a visible image, the exposed electrophotographic film 12 is transported past a toning unit 46 that subjects the exposed film to charged toner particles which are, in an attraction toning process, attracted to the charged areas of the film 12.

In certain recorder applications, it may be desirable to locate an electrode 48 that subtends the area of the film 12 being developed by the toning unit 46. The electrode 48 is also connected to a conventional high voltage power supply 50. The polarity of the potential applied to electrode 48 is the same as the polarity of the potential applied to corona charging unit 40. One purpose of electrode 48 is to maintain a constant spacing between the exposed surface of the electrophotographic film 12 and the toning unit 46. This is accomplished by maintaining the conductive layer of the electrophotographic film 12 at a known potential, such as ground, and by applying a known potential of about 1500 to 1700 volts to electrode 48 thereby developing an electrostatic attractive force between the surface of electrode 48 and the conductive layer of the electrophotographic film 12.

Figure 2:
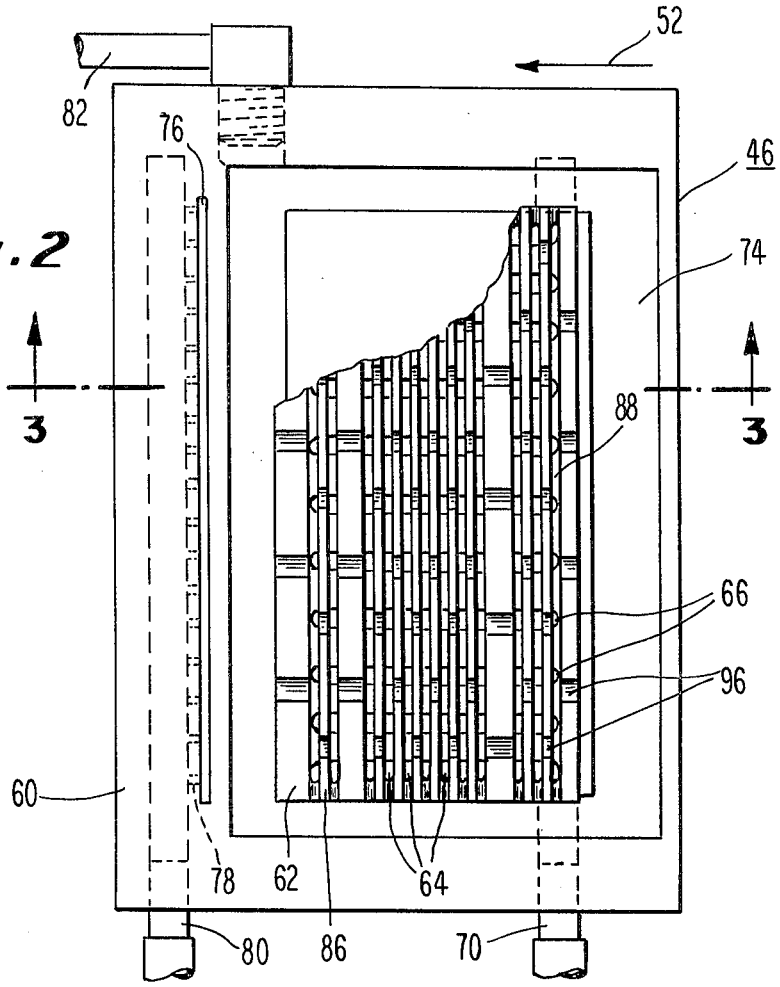
FIG. 2 is a plan view of a liquid toner application unit that includes the development electrode arrangement.
Figure 3:
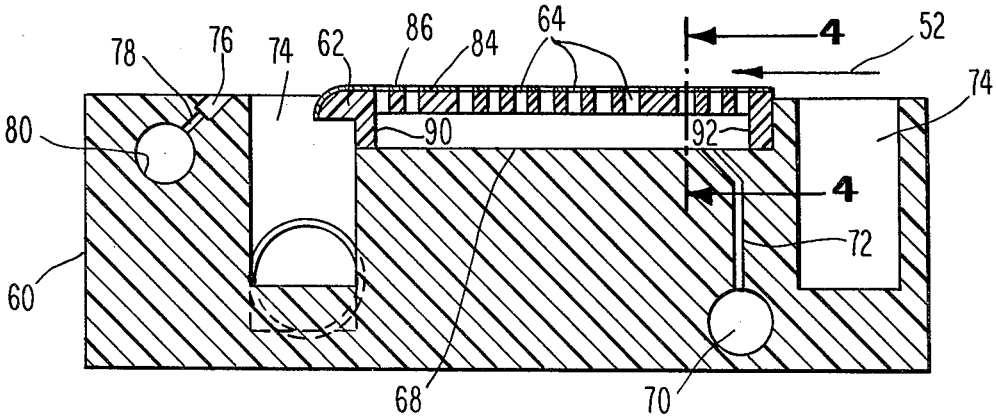
FIG. 3 is a cross-sectional view of the liquid toner application unit and development electrode arrangement taken along line 3—3 of FIG. 2.
Figure 4:
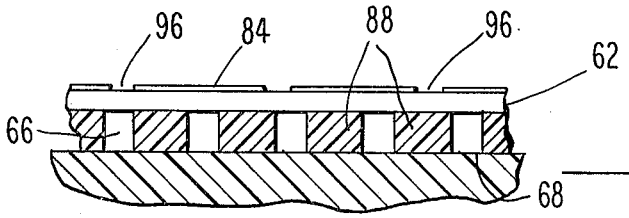
FIG. 4 is a partial cross-sectional view of a portion of the liquid toner application unit and development electrode arrangement taken along the line 4—4 of FIG. 3.

Referring now to FIGS. 2, 3 and 4 there is shown a preferred embodiment of the toner application unit 46 that includes the development electrode arrangement of this invention. The electrophotograhic film 12 (not shown) travels over the toner application unit 46 traveling from right to left as indicated by arrow 52 in FIGS. 2 and 3. In the depicted embodiment, the toner application apparatus 46 includes a base member 60 and a toner head member 62. Extending down from the upper surface of toner head 62 are a plurality of narrow slots 64 which extend in a direction perpendicular to the direction 52 in which the film 12 is traveling. The slots 64 extend substantially across the toner head 62 so that they extend across the entire width of that portion of the film 12 that is being toned. Thus, the upper portion of toner head 62 is divided into a plurality of alternating toner application slots 64 and rows of thin, electrode bearing members 86. Extending up from the lower surface of toner head 62 are a plurality of channels 66, each having a central axis which is generally parallel to the plane of the upper surface of the toner head 62 and generally parallel to the direction 52 of travel of electrophotographic film 12. The channels 66 extend up through the toner head 62 until they intersect the slots 64 extending down from the upper surface of toner head 62. Thus, the lower portion of toner head 62 is divided into a plurality of alternating toner feed channels 66 and support members 88 for the thin electrode bearing members 86. When the toner head 62 is placed on surface 68 of the base member 60, surface 68 converts the channels 66 into a plurality of ducts as shown in FIGS. 3 and 4. Each toner fluid duct is connected to a main toner distribution passage 70 by means of a connecting passageway 72. As best shown in FIG. 3, the ends of channel 66 are closed off by vertical wall portion 90, 92 of toner head 62 and connecting passageways 72 are located very close to the end of channels 66 over which film 12 first passes. Completely surrounding the periphery of the toner head 62 is an overflow moat 74 for catching spent toner fluid that overflows the toner head 62. The overflow moat 74 connects with a conduit 82 through which the spent toner fluid is removed from the toner unit 46. The base member 60 can include a toner removal slot 76 over which the film 12 passes after it has passed over the toner head 62 and the overflow moat 74. The slot 76 is connected to a toner removal passage 80 by means of a plurality of connecting passageways 78.

In one preferred embodiment of the toner unit 46, as shown in FIGS. 3 and 4, the toner base member 60 and the lower portion of the toner head 62 is made out of a light weight non-conductive material and only the thin upper layer 84 of the toner head is made out of a conductive metal such as copper which acts as a development electrode. In one constructed embodiment of toner head 62, the width of slots 64 and the width of the narrower electrode bearing elements 86 are on the order of 0.05 to 0.06 inches, while the width of channels 66 are about 0.125 inches wide and the support members 88 are about 0.25 inches wide. Thus, the support members 88 provide considerable structural strength to the thin, long electrode bearing elements 86. As best shown in FIG. 3, portions 96 of the thin metallic layer 84 are removed from each row and between each row along the edges of the toner head 62 thereby creating an array of ½ inch or one inch electrically isolated electrode segments. The location of the removed portions is staggered in the different rows so that every element of the film across the entire width of the film being developed passes directly over at least one electrode segment.

In operation, liquid toner fluid is pumped from a liquid toner source (not shown) into the main liquid toner distribution passage 70, and then through connecting passageways 72 into each toner distribution duct as formed by channels 66 and the surface 68 of the base member 60. After the liquid toner fluid fills the toner distribution ducts, the level of the liquid toner fluid eventually flows up through slots 64 and into the space between the electrode segment and electrophotographic film 12. Each development electrode segment will have induced on it a potential that is greater than the average background charge potential of the area of film immediately over the electrode segment 86. Thus, if negatively charged toner particles are suspended in the liquid toner, the electrostatic field between the development electrode segment and the film 12 will prevent toner particles from being deposited on those areas of the film that have a charge potential that is less than the potential of the development electrode segment and will assist the deposition of charged toner particles onto the areas of the film that have a higher charge potential.

Although the electrode segments in any one row do not assist development across the entire width of the film, the electrode segments are so arrayed that as the film travels over succeeding rows of segments every element of film travels over a number of development electrode segments.

The main advantage of the segmented floating electrode over the single, large area floating development electrode is that under certain conditions the potential induced on the single, large area, floating electrode may be less than the background charge potential in certain areas of the film which will result in unwanted toner particles being deposited on those areas, whereas the use of segmented floating electrodes will either completely eliminate the undesired toning or, at least, significantly reduce the area over which the undesired toning occurs.

Although the described embodiment used electrode segments of a single length, except for the edges due to the brickwork pattern, it may be desirable to have varying length segments across a row. Thus, if the background charge potential is relatively constant over the width of the film, long electrode segments can be used, and if the background charge potential shows a relatively large variation over another portion of the film, shorter electrode segments can be used. Although this discussion has focused on the variation in background charge potential across the width of the film, the segmented floating electrode arrangement also provides for adjustment to variations in background charge potential along the length of the film which could be caused, for example, by fluctuation of the voltage applied to the charging corona or variations in the dark decay characteristic along the length of the film.

While the present invention has been described with respect to a specific embodiment thereof, it will be obvious to those skilled in the art that various charges and modifications may be made without departing from the invention in its broader aspects. For example, it will be apparent to those skilled in the art that this electrode arrangement can be used in a repulsion toning process. Furthermore, it is contemplated that the principles of the segmented floating electrode arrangement is not limited to applications in which film is continuously transported past the electrode arrangement, but could be applied to the development of a single frame as long as there is sufficient relative motion between the electrode arrangement and the frame being developed so that each element of the area being developed passes over at least one electrode segment. The amount of relative motion required can be minimized by reducing the size of the removed portions 96 of the thin metallic layer 84 and the width of slots 64. It is also contemplated that for other toning systems, it may be desirable to use different electrode segment shapes such as diamonds, circles, or stripes.

What is claimed as new and desired to be secured by Letters Patent of the United States is:

1. A development electrode assembly adapted to be located close to a charge retaining surface of a moving electrographic recording medium, said development electrode assembly assisting the deposition of electrostatically charged liquid toner particles onto the charge retaining surface from the space between the development electrode assembly and the recording medium, said electrode assembly comprising an array of a plurality of rows of development electrode segments each having a width less than the full width of the charged portion of the charge retaining surface, each segment located in closely spaced parallel relation to the charge retaining surface, each segment being electrically floating and isolated from all other segments, said rows extending in a direction transverse to the direction of movement of said recording medium and at least some of said rows containing a plurality of electrode segments, said electrode segments being staggered in different rows such that every element of the recording medium across the full width of the portion of the recording medium being toned passes directly over at least one segment.

2. A development electrode assembly as recited in claim 1 wherein each segment is rectangular in shape with the short dimension of the segment being parallel to the direction of travel of the recording medium.

3. A development electrode assembly as recited in claim 2 wherein the rectangular segments are arranged in rows, each row having a plurality of segments.

4. A development electrode assembly as recited in claim 3 wherein the rows of electrode segments are perpendicular to the direction of motion of the electrographic medium.

5. A development electrode assembly for controlling the deposition of electrostatically charged liquid toner particles on a charge retaining surface of a moving electrographic recording medium in accordance with an electrostatic charge pattern on the charge retaining surface, comprising:

a first electrically floating development electrode disposed in spaced parallel relation to the moving electrographic recording medium to be induced to an electrical potential related to the average potential of the portion of the charge retaining surface located adjacent said first development electrode, said development electrode having a width less than the full width of the charge retaining portion of the charge retaining surface; and a second electrically floating development electrode insulated from said first development electrode and disposed in spaced parallel relation to the moving electrographic recording medium such that the electrical potential induced on said second development electrode is at least in part influenced by the change on at least some of that portion of the width of the charge retaining surface which does not pass adjacent said first development electrode;

whereby each of said first and second development electrodes independently influences the deposition of toner particles on the charge retaining surface of the electrographic recording medium in accordance with the average potential of the area of the charge retaining surface located adjacent the respective development electrode.

* * * * *